United States Patent [19]

Pan

[11] Patent Number: 4,778,543

[45] Date of Patent: Oct. 18, 1988

[54] METHODS AND APPARATUS FOR MAKING ELECTRICAL CABLE

[75] Inventor: Ali Pan, Kingston, Canada

[73] Assignee: Northern Telecom Limited, Montreal, Canada

[21] Appl. No.: 30,006

[22] Filed: Mar. 25, 1987

Related U.S. Application Data

[63] Continuation-in-part of Ser. No. 846,542, Mar. 31, 1986, abandoned.

[51] Int. Cl.[4] ..... H01B 13/26

[52] U.S. Cl. ..... 156/54; 156/201; 156/203; 156/466; 156/500; 156/578; 174/102 C; 174/102 D; 428/379

[58] Field of Search ..... 156/52, 54, 244.11, 156/500, 53, 201, 203, 466, 578; 425/466; 428/379; 174/102 C, 102 D

[56] References Cited

U.S. PATENT DOCUMENTS

| | | | |
|---|---|---|---|
| 4,035,211 | 7/1977 | Bill et al. | 156/54 |
| 4,360,395 | 11/1982 | Suzuki | 156/54 |
| 4,477,298 | 10/1984 | Bohannon et al. | 156/54 |

*Primary Examiner*—Robert A. Dawson

*Attorney, Agent, or Firm*—R. J. Austin; C. W. Junkin

[57] ABSTRACT

In the making of an electrical cable, a metal shield is formed by wrapping metal strip around a cable core with longitudinal edges of the strip overlapping. The strip is corrugated with the corrugations nesting in the overlapped regions. A shield gap filler is provided by extruding a heated molten plastics material and directing it between the overlapped regions. Upon cooling, the filler hardens and bonds the edges together. A cable jacket is extruded around the shield.

4 Claims, 1 Drawing Sheet

1st PASS
2nd PASS

METHODS AND APPARATUS FOR MAKING ELECTRICAL CABLE

This application relates to methods and apparatus for making electrical cable and is a continuation-in-part of application Ser. No. 846,542 filed Mar. 31, 1986 in the name of Ali Pan, and now abandoned.

Electrical cable comprises a core having a conductor or a plurality of individually insulated conductors. The core is surrounded by a jacket of insulating material and between the core and the jacket a metal shield may be located, the shield surrounding the core and forming a protection for the core from environmental conditions such as the activities of gnawing animals or moisture. Normally the shield is also provided for connection to ground to electrically protect the core against lightning strikes.

The shield is formed by wrapping a strip of an appropriate metal around the core, preferably after incorporation of a core wrap, and after the longitudinal edge regions of the strip are overlapped, steps are then taken to seal the overlapping edge regions together. In some constructions, the overlapped edge regions are soldered together to provide a longitudinal soldered seam or joint and the jacket is then extruded around the shield. This soldered seam provides sufficient strength to the shield to ensure that the shield is not weaker at the overlapped edge regions than in other regions and successfully withstands tensile, torsional and bend loads placed upon the cable. By a later development, it has become accepted practice to form shields from metal strip which previously has been covered on its surfaces with a bonded thermoplastic coating such as polyethylene acrylic acid copolymer. By the use of this material, the soldering step is avoided as the coated surfaces of the shield overlap each other at the edge regions of the strip and heat transferred from the jacket material during extrusion causes a softening or melting of the plastic coating to cause it to fuse together between the overlapped edge regions. The intention of the resulting fused joint is to provide a moisture seal as in the previous construction and also to produce an acceptable strength to the joint which will be satisfactory under all loading situations.

However, problems have been found when fusing together the thermoplastic coatings bonded to the strip. These problems are mainly found in conventional constructions in which metal strips for the shields have transversely extending corrugations and at the overlapping edge regions the ends of the corrugations nest one into another. Unfortunately, the opposing surfaces of the overlapped ends of the corrugations are not complementarily shaped so that there is not a continuous and intimate contact between their surface plastic coatings. It is thus not unusual to discover that the surface plastic coatings contact each other only along the sloping sides between peaks and that at the peaks themselves gaps exist between the coated surfaces. In such a situation, it is not uncommon for the gaps to be so large that the plastic coatings, upon softening, cannot flow sufficiently into the gaps to completely fill them. As a result, the gaps remain in the finished cable structure thereby providing a lack of longitudinal continuity in the fused joint at the overlapped edge regions which limits its strength in an unacceptable manner. Hence, bursting open of the overlapped edge regions of the shield may occur, for instance, when coiling or twisting the cable.

The damage may be sufficiently severe that one of the edges of the shield may cut through the jacket thereby completely ruining the cable.

In addition to this, it is found that the gaps present at the fused joint are sufficient to allow moisture to penetrate from outside the shield and into the core region of the cable thereby affecting the electrical characteristics thereof.

It is known to fill the gaps present at the fused joint with a molten copolymer adhesive which solidifies within the gaps to provide a moisture barrier. As described in U.S. Pat. No. 4,035,211 issued July 12, 1977 in the names of R. G. Bill et al, and in U.S. Pat. No. 4,477,298 issued Oct. 16, 1984 in the names of W. D. Bohannon, Jr., et al, the overlapped edge regions of the shield are forced apart, and the molten copolymer adhesive is applied between the separated edge regions. The separated edge regions are then forced back together. The copolymer adhesive solidifies between the overlapped edge regions to fill the gaps.

While the above method fills the gaps present in the fused joint to provide a moisture barrier, the resulting fused joint has inadequate bond strength for some cable applications. Hence, under adverse conditions of use, as described above, the fused joint may burst, leading to the harmful consequences described above.

Moreover, the apparatus described in the above patents for separating edge regions of the shield, applying molten copolymer adhesive between the separated edge regions, and forcing the edge regions back together is relatively complex and expensive. U.S. Pat. No. 4,035,211 describes apparatus comprising a seam separating and supporting tool having an upstream separating portion for forcing the overlapped edge regions of the shield apart and a downstream longitudinally extending supporting portion, a nozzle disposed radially outward of the supporting portion for applying molten copolymer adhesive between the separated edge regions, and a pair of opposed closing rollers disposed downstream of the nozzle and radially outward of the supporting portion for forcing the separated edge regions back together against the supporting portion.

U.S. Pat. No. 4,477,298 describes a closing die which incorporates a nozzle for introducing molten copolymer adhesive between overlapped edge regions of the shield before they are forced together. A different closing die is required for each size of cable manufactured, and the line must be shut down to change closing dies each time a different cable size is to be manufactured on that line. Each of the closing dies is difficult and expensive to machine.

The present invention seeks to provide a seam sealing method which provides a better bond between overlapped edge regions of the shield and a relatively simple and inexpensive apparatus for performing this method.

Accordingly, the present invention provides a method of making an electrical cable comprising moving a core of the cable along a passline, forming a metal shield by wrapping a metal strip around the core and progressively along its length and causing edge regions of the strip to extend longitudinally and to overlap, the strip having a bonded coat of polyolefin thermoplastic homopolymer material and being formed with transversely extending corrugations and the ends of the corrugations nesting together at the overlapped edge regions, providing a shield gap filler by extruding a molten polyolefin thermoplastic homopolymer material and directing it between the overlapped edges to fill any gap between the edge regions, the homopolymer material of the filler being such as to harden and bond the edge regions together upon cooling, and extruding a dielectric plastic jacket around the shield.

With the above process, the continuity of the joint between the edge regions is assured. The polyolefin thermoplastic homopolymer provides a stronger bond than is provided by the known hot melt copolymer adhesives. The molten homopolymer material fuses to the bonded coat when this softens under the influence of heat provided by the step of extruding the jacket onto the shield.

The present invention also includes apparatus for making electrical cable comprising means for sealing a seam between two longitudinally extending edge regions of a resilient shield wrapped around a cable core as the shield and core are advanced together along a passline, the sealing means comprising a delivery tube for connection to an extruder, the delivery tube including a delivery nozzle having a delivery end which is elongate laterally of the nozzle to define an elongate opening for delivery of molten polymer material between separated edges of the shield, the nozzle disposed with its delivery end and opening extending in elongate manner in the direction of the passline, with the delivery end having an upstream edge region for separating the overlapped edge regions of the shield.

This relatively simple and inexpensive apparatus relies upon the upstream edge of the nozzle to spring overlapping edge regions of the shield apart for application of molten polymer material between the edge regions, and relies upon the resilience of the shield to bring the separated edge regions back together downstream of the nozzle. Thus, no distinct separating and supporting tool or closing rollers additional to those used in conventional processing of shielded cables are required. The nozzle is simple to manufacture, and a single nozzle may be used in the manufacture of a variety of cable sizes.

One embodiment of the invention will now be described, by way of example, with reference to the accompanying drawings, in which.

Figures 1, 2, 3, 4, 5, 6:
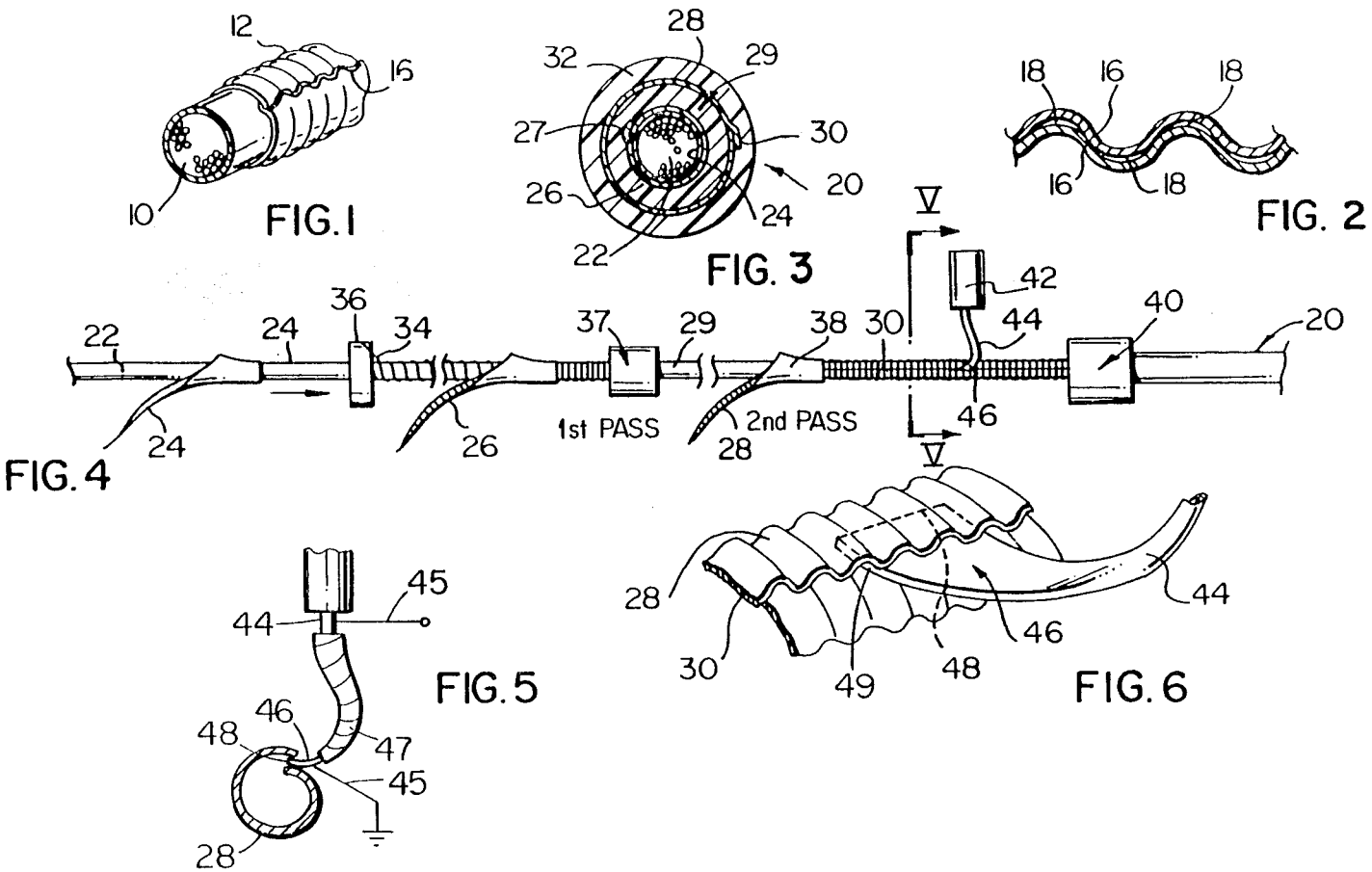
FIG. 1 is an isometric view of a shield covered cable core according to a prior art construction.
FIG. 2 is a view showing overlapped edge regions of the shield in the construction of FIG. 1.
FIG. 3 is a cross-sectional view through a cable made according to the embodiment.
FIG. 4 is a diagrammatic side elevational view of apparatus according to the embodiment.
FIG. 5 is a cross-sectional view taken along line 'V—V' in FIG. 4 and on a larger scale.
FIG. 6, on a larger scale than FIG. 5, is an isometric view of part of a delivery tube for molten plastics material showing the tube in use when delivering material into a shield gap area.

As shown in FIG. 1, a conventional cable structure comprises a core 10 having a corrugated steel shield 12 which is formed from strip wrapped around it. The core is formed from a plurality of twisted pairs of conductors. The shield 12 has overlapped edge regions 16 in which the corrugations of the shield are nested together. This structure is plainly shown in the enlarged view of FIG. 2. As can be seen from FIG. 2, in this particular structure, the metal strip from which the shield is formed is provided with a bonded covering or coating of a thermoplastics material such as polyethylene acrylic acid copolymer. The opposing and nested peak regions are not in contact and the corrugations contact each other solely along their sloping sides which extend between peak regions. It is the intention that when a jacket (not shown) is extruded over the shield covered core, the opposing thermoplastic coatings in the overlapped edge regions will soften and become fused together so as to seal any gap between the corrugations in addition to bonding them together. However, in practice, because the corrugations only contact along their sloping sides, then it is not unknown for there to be insufficient of the coating material to enable it to flow into and completely fill gaps between the corrugations to provide an effective continuous joint and seal. As a result, as can be seen from FIG. 2, in at least some constructions the plastic coating material is fused together solely along the sloping sides of the corrugations and gaps 18 remain at the peak regions. The joint between the overlapped edges is then particularly weak and may burst apart. In addition, paths are provided through the gaps for moisture ingress.

The gaps may be filled according to previously known methods with hot melt copolymer adhesive such as ethylene acrylic acid copolymer or polyethylene acrylic acid copolymer. However, these copolymer materials do not provide a bonding strength which is adequate to prevent bursting of the seam under particularly adverse cable handling conditions. Moreover, the known apparatus for filling the gaps with copolymer adhesives is relatively complex and expensive.

The invention provides a method and apparatus for solving the above problems. In the embodiment of the invention, a cable 20 constructed as shown in FIG. 3 is formed. The cable 20 comprises a core 22 having a plurality, namely fifty pairs, of twisted together individually insulated telecommunications conductors. Surrounding the core is a plastics core wrap 24 around which is disposed a corrugated copolymer coated aluminum sheath 26. This has overlapped edge regions 27 with the ends of the corrugations nested together. Surrounding the aluminum sheath is a first polyethylene jacket 29 covered by a shield 28 formed from corrugated steel strip with overlapped edge regions 30. Surrounding the shield 28 is a second polyethylene jacket 32. The basic structure of this cable as described above is conventional and the steel strip of the shield 28 is covered on each of its surfaces with a layer of medium density polyethylene homopolymer bonded to the steel.

In the manufacture of the cable 20, as shown in FIG. 4, the core 22 is wrapped with the core wrap 24 and a binding thread 34 is applied from a spool 36 followed by application of the corrugated sheath 26 as the core moves along a passline. After the aluminum sheath 26 has been wrapped around the core wrap covered core and the first jacket applied in extruder crosshead 37 in a first pass, then the shield 28 is applied in a second pass. The above procedure is conventional.

A shield application means 38 is provided for applying the shield in a shield application station. The means 38 is also of conventional construction and applies the shield 28 with its edge regions overlapping and the opposed surfaces of the bonded layers is contact before the core reaches jacket extruder having extruder crosshead 40.

Intermediate the shield application station and the crosshead 40 is disposed a shield gap filling station. In the shield gap filling station is disposed a secondary extruder 42 for delivery of molten polyolefin thermoplastic homopolymer, such as medium density polyethylene material between the overlapped edge regions of the shield. The secondary extruder has an outlet leading to a sealing means comprising a delivery tube 44 with an outlet nozzle 46 which is disposed at a region for separating overlapped edge regions of the shield and delivering the molten polymer material between the separated edge regions of the shield. In this case, as can be seen from FIGS. 5 and 6, the nozzle opens for the issue of molten plastics material between the separated overlapped edge regions. Also, as is clear from FIG. 6, the delivery tube is of circular cross-section and the nozzle changes in cross-sectional shape from a circular to an elongate shape at its delivery end 47 to define the elongate opening 48. As can be seen from FIG. 6, the delivery end 47 is wider in the direction of the passline than in a direction normal to it for the purpose of ensuring that the nozzle may separate the overlapping edge regions of the shield without permanently deforming them. The delivery end of the nozzle has a major axis approximately 0.3 inches long and a minor axis approximately 0.1 inches long. The delivery tube is made of stainless steel and is provided with an electrical terminals 45 to which approximately 1.5 v is applied to cause an electrical current of up to 400 A to flow in the nozzle. This current heats the nozzle to between 500° F. and 600° F. to maintain the extrusion temperature of the molten polymer material as it approaches the nozzle. The nozzle is wrapped in insulation to improve heat retention and for safety.

In use of the apparatus, the shield covered core proceeds through the shield gap filling station as it approaches the extruder crosshead 40. As the shield passes the nozzle 46, an upstream edge region 49 of the delivery end 47 of the nozzle separates overlapped edge regions and molten polyethylene homopolymer is passed through the nozzle to fill any gaps which exist between the corrugations. After passing the nozzle, the overlapping edges spring back into contact due to the resilience of the shield. The heated and molten homopolymer material serves to slightly soften the bonded homopolymer coating on the shield surfaces and the heat produced in the jacketing procedure during passage of the core through the crosshead 40 also assists in softening the bonded coating so that the homopolymer material from the nozzle 48 fuses to the homopolymer bonded coating and completely fills any gaps between the corrugations.

In the finished construction therefore, no gaps exist between the overlapped edges of the shield. The shield is thus provided with a continuous longitudinal joint at its overlapped edge regions and this joint not only prevents ingress of moisture but also is of acceptable strength for its desired function. The hompolymer thermoplastic material provides a stronger bond than known copolymer adhesive. In tests which have been performed, a cable has passed bend and torsion tests at temperature limits between −20° C. and 80° C. In addition to this, overlap adhesion tests have been performed upon the overlapped edge regions of two samples of the above-described cable. The results of this are shown in Table 1. The results are given grams/milimeter across the width of the overlap.

In the overlap adhesion tests, each sample was a section of cable jacket and shield and, including the overlap, has been placed in an "Instron" tensile testing machine. With one jaw holding the jacket and the other jaw holding the radially inner overlapped edge, the machine has been operated to peel the inner edge from the outer edge in a longitudinal direction of the cable, i.e. in the longitudinal direction of the overlap. Thus the fall width of the overlap has been simultaneously subjected to the peeling load.

TABLE I

| | SAMPLE #1 | | | SAMPLE #2 | | |
|---|---|---|---|---|---|---|
| | MIN. | AVG. | MAX. | MIN. | AVG. | MAX. |
| TEST #1 | 443 | 821 | 1186 | 429 | 821 | 1321 |
| TEST #2 | 271 | 786 | 1250 | 371 | 786 | 1214 |
| TEST #3 | 271 | 786 | 1286 | 357 | 786 | 1257 |

It is clear from the above table that the overlap adhesion tests showed that the overlapped edge regions were bonded together in a completely satisfactory manner for this particular cable construction. This acceptable degree of strength was provided because of the continuous joint between the overlapped edge regions which was ensured by the fact that the secondary extruder made it possible to fill any gaps existing between the facing surfaces of the corrugations.

Note that the apparatus constructed according to the embodiment relies upon the upstream edge of the nozzle to spring the overlapping edge regions of the shield apart for application of the molten polymer material between the edge regions, and relies upon the resilience of the shield to bring the separated edge regions back together downstream of the nozzle. Consequently, the distinct separating and supporting tool and special reclosing rollers described in U.S. Pat. No. 4,035,211 are not required. Standard closing apparatus as used in standard shielded cable manufacturing techniques are adequate. Moreover, the apparatus constructed according to the embodiment does not require expensive machining operations in its manufacture, as does the closing die described in U.S. Pat. No. 4,477,298, and may be adapted to the manufacture of a variety of cable sizes by mere radial movement of the nozzle with respect to the passline.

What is claimed is:

1. A method of making an electrical cable comprising moving a core of the cable along a passline, forming a metal shield by wrapping a metal strip around the core and progressively along its length and causing edge regions of the strip to extend longitudinally and to overlap, the strip having a bonded coat of polyolefin thermoplastic homopolymer material and being formed with transversely extending corrugations and the ends of the corrugations nesting together at the overlapped edge regions, providing a shield gap filler by extruding a molten polyolefin thermoplastic homopolymer material and directing it between the overlapped edge regions to fill any gap between the edge regions, the homopolymer material of the filler being such as to harden and bond the edge regions together upon cooling, and extruding a dielectric plastic jacket around the shield.

2. A method according to claim 1 comprising supplying sufficient heat from the filler and during extrusion of the jacket to soften the bonded coat of thermoplastic homopolymer between the overlapped edge regions and fuse it to the filler material.

3. Apparatus for making electrical cable comprising means for sealing a seam between two longitudinally extending edge regions of a resilient shield wrapped around a cable core as the shield and core are advanced together along a passline, the sealing means comprising a delivery tube for connection to an extruder, the delivery tube including a delivery nozzle having a delivery end which is elongate laterally of the nozzle to define an elongate opening for delivery of molten polymer material between separated edges of the shield, the nozzle disposed with its delivery end and opening extending in elongate manner in the direction of the passline, with the delivery end having an upstream edge region for separating the overlapped edge regions of the shield.

4. Apparatus according to claim 3 comprising means for passing electrical current through the delivery tube to heat the delivery tube so as to maintain the polymer material in a molten condition between the extruder and the delivery nozzle.

* * * * *